US011173717B2

(12) United States Patent
Kachi et al.

(10) Patent No.: US 11,173,717 B2
(45) Date of Patent: Nov. 16, 2021

(54) LIQUID DISCHARGE APPARATUS

(71) Applicants: Yasuhiko Kachi, Kanagawa (JP); Shohei Saito, Kanagawa (JP)

(72) Inventors: Yasuhiko Kachi, Kanagawa (JP); Shohei Saito, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/928,175

(22) Filed: Jul. 14, 2020

(65) Prior Publication Data

US 2021/0023847 A1 Jan. 28, 2021

(30) Foreign Application Priority Data

Jul. 24, 2019 (JP) ..... JP2019-136415
May 20, 2020 (JP) ..... JP2020-088073

(51) Int. Cl.
*B41J 2/175* (2006.01)
*B41J 29/377* (2006.01)

(52) U.S. Cl.
CPC ..... *B41J 2/175* (2013.01); *B41J 29/377* (2013.01)

(58) Field of Classification Search
CPC ..... B41J 2/18; B41J 11/002; B41J 2202/12; B41J 2202/20; B41J 2202/08; B41J 13/226; B41J 2/14201; B41J 2/175; B41J 29/377
USPC ..... 347/5, 17, 18
See application file for complete search history.

(56) References Cited

U.S. PATENT DOCUMENTS 8,070,248 B2 * 12/2011 Ogama ..... B41J 2/175 347/14
8,616,689 B2 * 12/2013 von Essen ..... B41J 2/175 347/89
2015/0124019 A1 * 5/2015 Cruz-Uribe ..... B41J 2/14 347/18
2016/0257113 A1 9/2016 Takeuchi et al.
2017/0173946 A1 6/2017 Yamanaka et al.

FOREIGN PATENT DOCUMENTS

JP 10-086411 4/1998

* cited by examiner

*Primary Examiner* — An H Do
(74) *Attorney, Agent, or Firm* — Duft & Bornsen, PC

(57) ABSTRACT

A liquid discharge apparatus includes a head configured to discharge a liquid, a circulation passage through which a temperature-controlled liquid circulates, at least two heat generation portions different in heat generation amount from each other, and a cooler configured to cool the temperature-controlled liquid. The circulation passage is coupled to the head. The at least two heat generation portions are thermally coupled with the circulation passage in an ascending order of heat generation amount and downstream from the cooler in a direction of flow in the circulation passage.

11 Claims, 16 Drawing Sheets

| TH1 | HEAD DRIVE DUTY |
|---|---|
| 10°C ≤ TH1 | 100%(40kHz) |
| 17°C ≤ TH1 | 70%(28kHz) |
| 20°C ≤ TH1 | 50%(20kHz) |
| 23°C ≤ TH1 | OFF |

LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2019-136415, filed on Jul. 24, 2019, and 2020-088073, filed on May 20, 2020, in the Japan Patent Office, the entire disclosure of each of which is hereby incorporated by reference herein.

BACKGROUND

Technical Field

The present disclosure relates to a liquid discharge apparatus.

Related Art

A liquid discharge apparatus includes a head to discharge a liquid and components that generate heat (heat generators). Examples of the heat generators include a pressure generator, such as a piezoelectric element, to generate pressure to discharge the liquid, a driver integrated circuit (IC), such as a switching circuit, and a head drive board disposed adjacent to the head and including a power amplification unit. The head drive board generates a drive waveform and drives the piezoelectric element. In the head, the temperature of the liquid to be discharged rises inherent to the heat generated by the heat generators, resulting in fluctuations in liquid discharge properties.

For example, a liquid whose temperature is controlled (i.e., a temperature-controlled liquid) is supplied to the head to minimize such a temperature rise.

SUMMARY

According to an embodiment of this disclosure, a liquid discharge apparatus includes a head configured to discharge a liquid, a circulation passage through which a temperature-controlled liquid circulates, at least two heat generation portions different in heat generation amount from each other, and a cooler configured to cool the temperature-controlled liquid. The circulation passage is coupled to the head. The at least two heat generation portions are thermally coupled with the circulation passage in an ascending order of heat generation amount and downstream from the cooler in a direction of flow in the circulation passage.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
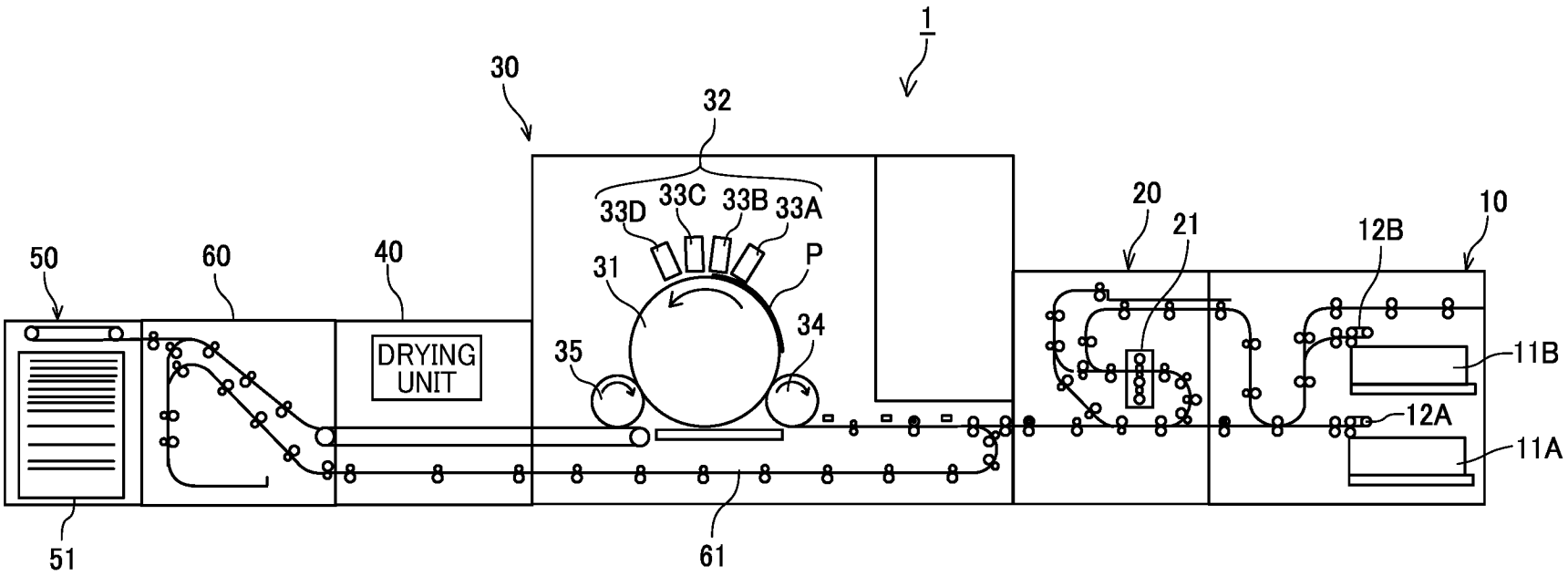
FIG. 1 is a schematic cross-sectional view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Referring now to the drawings, wherein like reference numerals designate identical or corresponding parts throughout the several views thereof, embodiments of this disclosure are described. As used herein, the singular forms "a," "an," and "the" are intended to include the plural forms as well, unless the context clearly indicates otherwise.

A description is given of a printer as a liquid discharge apparatus according to a first embodiment of the present disclosure, with reference to FIG. 1. FIG. 1 is a schematic cross-sectional front view of the printer according to the first embodiment of the present disclosure.

A printer 1 includes a loading unit 10 to load a sheet P into the printer 1, a pretreatment unit 20, a printing unit 30, a drying unit 40, an unloading unit 50, and a reversing unit 60. In the printer 1, the pretreatment unit 20 applies, as required, a pretreatment liquid onto the sheet P fed (supplied) from the loading unit 10, the printing unit 30 applies a liquid to the sheet P, thereby performing printing, and the drying unit 40 dries the liquid adhering to the sheet P, after which the sheet P is ejected to the unloading unit 50.

The loading unit 10 includes loading trays 11 (a lower loading tray 11A and an upper loading tray 11B) to store a plurality of sheets P, feeders 12 (12A and 12B) to separate and feed the sheets P one by one from the loading tray 11, and feeds the sheet P to the pretreatment unit 20.

The pretreatment unit 20 includes an application device 21 that coats an image formation surface of the sheet P with a treatment liquid having an effect of aggregating a colorant of ink to prevent bleed-through.

The printing unit 30 includes a drum 31 (a rotator) to carry and convey the sheet P on an outer peripheral surface thereof and a liquid discharge device 32 to discharge the liquid toward the sheet P carried on the drum 31.

The printing unit 30 includes transfer cylinders 34 and 35. The transfer cylinder 34 receives the sheet P from the pretreatment unit 20 and forwards the sheet P to the drum 31. The transfer cylinder 35 receives and forwards the sheet P conveyed by the drum 31 to the drying unit 40.

The transfer cylinder 34 includes a sheet griper to grip the leading end of the sheet P conveyed from the pretreatment unit 20 to the printing unit 30. The sheet P thus gripped is conveyed as the transfer cylinder 34 rotates. The transfer cylinder 34 forwards the sheet P to the drum 31 at a position opposite the drum 31.

Similarly, the drum 31 includes a sheet gripper on the surface thereof, and the leading end of the sheet P is gripped by the sheet gripper. The drum 31 has a plurality of suction holes dispersedly on the surface thereof, and a suction device generates a suction airflow orienting inward from a predetermined suction hold of the drum 31.

On the drum 31, the sheet gripper grips the leading end of the sheet P forwarded from the transfer cylinder 34, and the sheet P is attracted to and carried on the drum 31 by the suction airflows by the suction device. As the drum 31 rotates, the sheet P is conveyed.

The liquid discharge device 32 includes discharge units 33 (33A to 33D) to discharge liquids. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K). In addition, a discharge unit to discharge a special liquid, that is, a liquid of spot color such as white, gold, or silver, can be used.

The discharge operation of the discharge unit 33 of the liquid discharge device 32 is controlled by a drive signal corresponding to print data. When the sheet P carried on the drum 31 passes through a region facing the liquid discharge device 32, the respective color liquids are discharged from the discharge units 33, and an image corresponding to the print data is formed.

The drying unit 40 dries the liquid applied onto the sheet P in the printing unit 30. As a result, a liquid component such as moisture in the liquid evaporates, and the colorant contained in the liquid is fixed on the sheet P. Additionally, curling of the sheet P is inhibited.

The reversing unit 60 reverses, in switchback manner, the sheet P that has passed through the drying unit 40 in double-sided printing. The reverted sheet P is fed back to the upstream side of the transfer cylinder 34 through a conveyance passage 61 of the printing unit 30.

The unloading unit 50 includes an unloading tray 51 on which a plurality of sheets P is stacked. The plurality of sheets P conveyed through the reversing unit 60 is sequentially stacked and held on the unloading tray 51.

Figure 2:
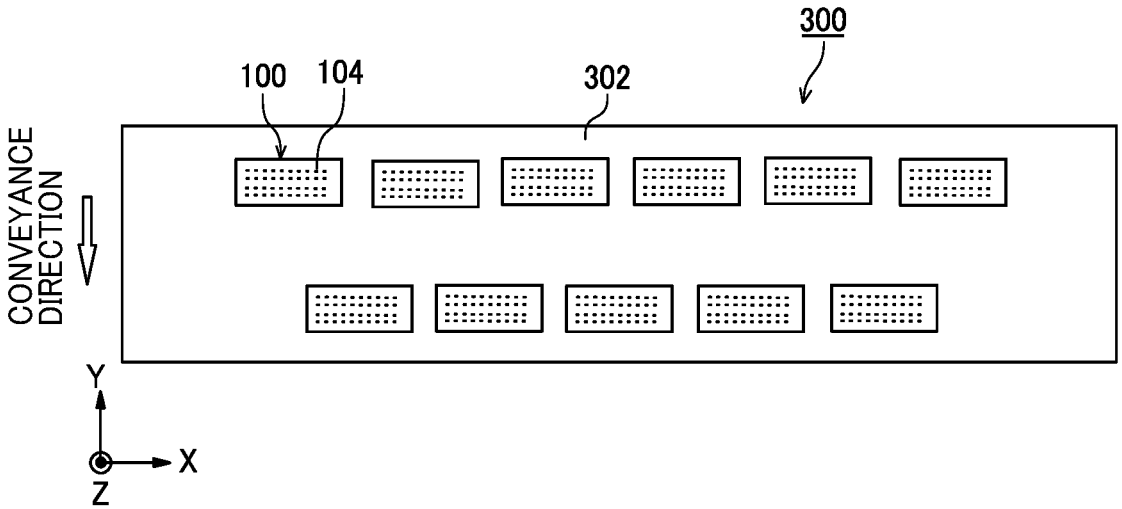
FIG. 2 is a plan view of a head unit as a discharge unit of the liquid discharge apparatus as viewed from a nozzle face side.

Next, an example of a head unit serving as the discharge unit is described with reference to FIG. 2. FIG. 2 is a plan view of the head unit as viewed from a surface of a nozzle plate (i.e., a nozzle face).

The head unit 300 includes a plurality of heads 100 to discharge a liquid. The heads 100 are in a staggered arrangement on a head mount 302.

Each head 100 has a plurality of nozzle rows in each of which a plurality of nozzles 104 to discharge liquid is lined (in this example, four rows, but the number of rows is not limited thereto).

Figure 3:
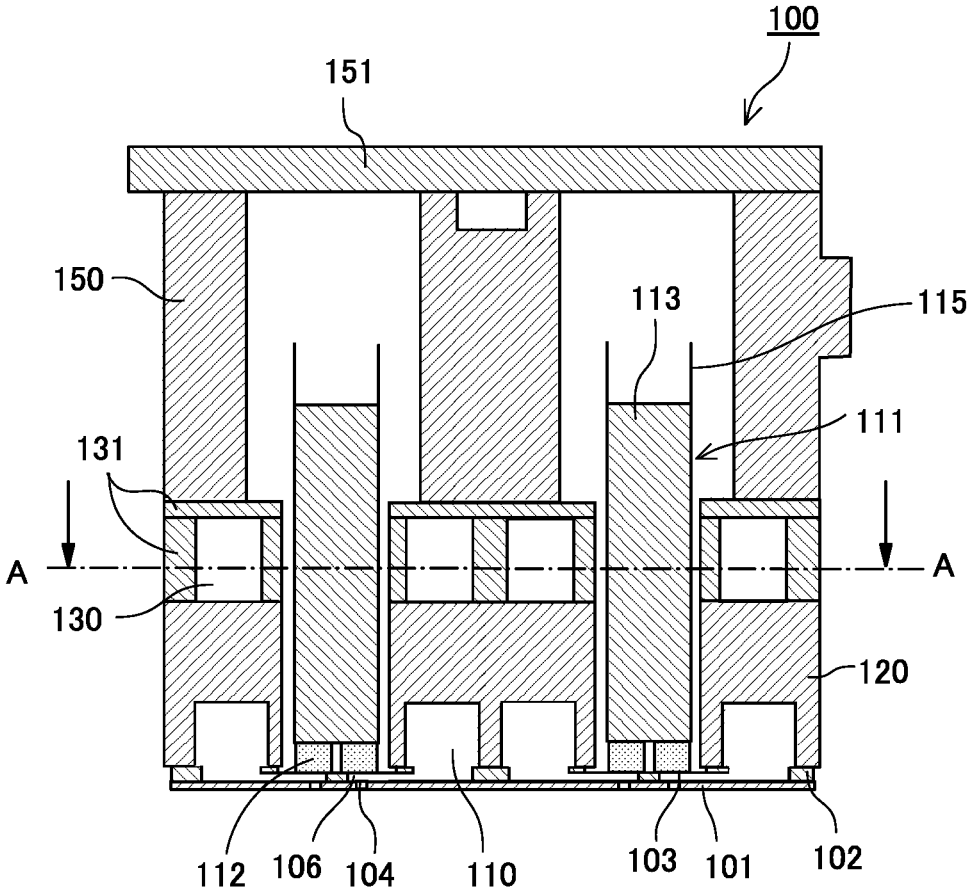
FIG. 3 is a cross-sectional view of an example of a head of the head unit, along a short-side direction (perpendicular to a nozzle row direction in which a nozzle row extends)
Figure 4:
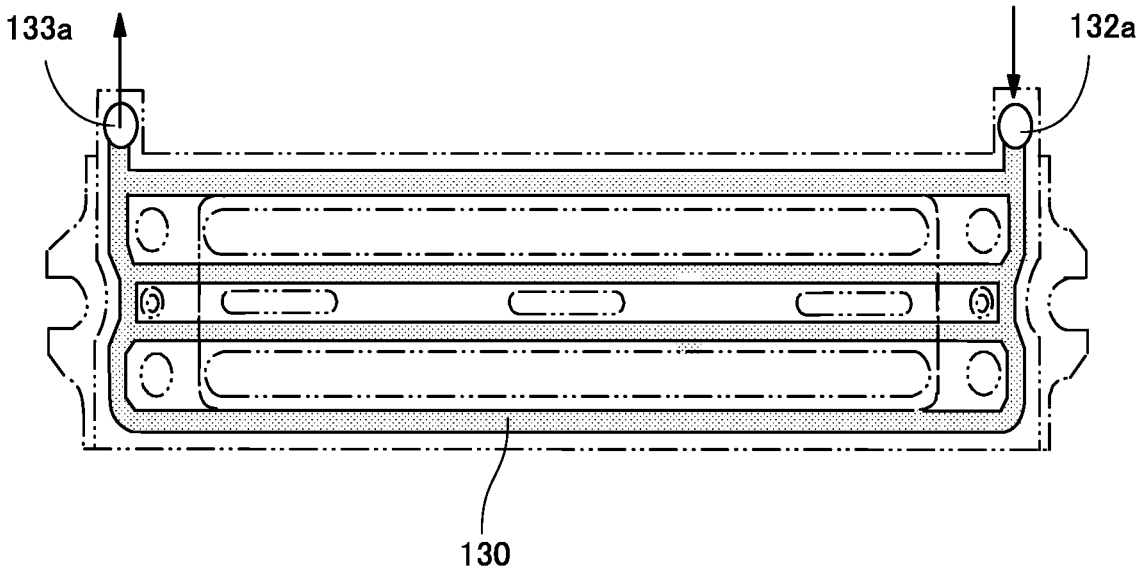
FIG. 4 is a plan view of a temperature-controlled liquid channel in the head, taken along the line A-A in FIG. 3.
Figure 5:
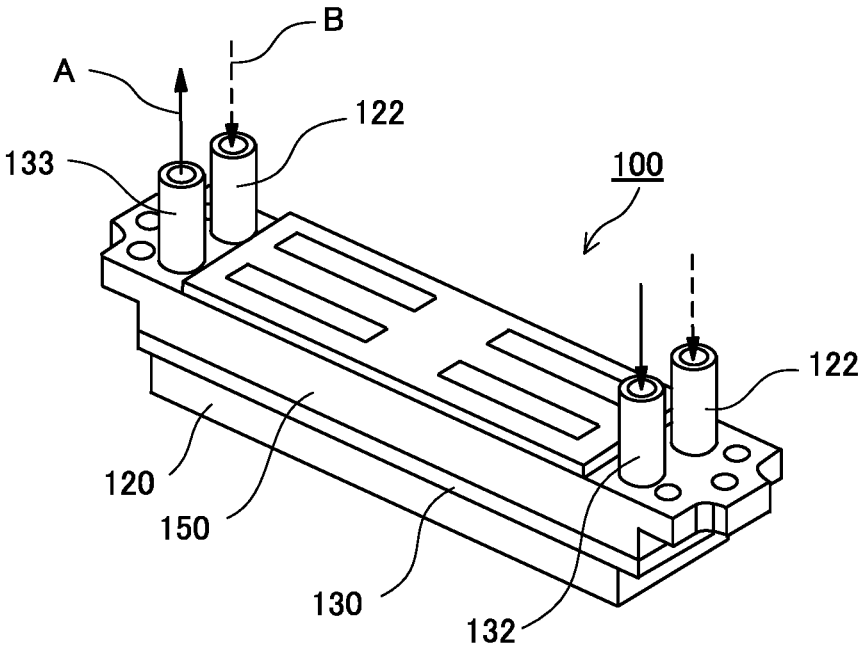
FIG. 5 is a perspective view of the head and illustrates ports for an ink and a temperature-controlled liquid.

Next, an example of the head 100 is described with reference to FIGS. 3 and 5. FIG. 3 is a cross-sectional view of the head 100 along a short-side direction of the head 100 (perpendicular to the nozzle array direction in which a nozzle row extends). FIG. 4 is a plan view of a temperature-controlled liquid channel taken along the line A-A in FIG. 3. FIG. 5 is a perspective view of the head and illustrates ports for an ink and a temperature-controlled liquid.

The head 100 includes a nozzle plate 101 in which the nozzles 104 are formed, a channel substrate 102 that defines channels such as pressure chambers 106 communicating with the nozzles 104, and diaphragms 103 forming walls of the pressure chambers 106, which are sequentially stacked. The head 100 further includes a piezoelectric actuator 111, as a pressure generator to generate pressure to discharge liquid, and a frame 120 that is a casing also serving as a common channel member.

The piezoelectric actuator 111 includes a plurality of columnar piezoelectric elements 112 on a base 113. The piezoelectric element 112 is joined to the diaphragm 103. A wiring member 115 of a flexible wiring board is connected to the piezoelectric elements 112.

The frame 120, which also serves as the common channel member, forms a common supply channel 110 to supply the liquid (ink) to be discharged, to the pressure chamber 106.

To the frame 120, a temperature-controlled liquid channel member 131 is joined. The temperature-controlled liquid channel member 131 defines the temperature-controlled liquid channel 130 through which a temperature-controlled liquid flows in the head 100. The temperature-controlled liquid channel member 131 includes a temperature-controlled liquid supply port 132*a* to supply the temperature-controlled liquid to the temperature-controlled liquid channel 130, and a temperature-controlled liquid collection port 133*a* from which the temperature-controlled liquid is discharged outside for collection.

Accordingly, in the head 100, the common supply channel 110, which is a flow channel for ink, and the temperature-controlled liquid channel 130 are thermally coupled. The frame 120, serving as the casing of the head 100, defines the wall of the temperature-controlled liquid channel 130, and is naturally thermally coupled to the temperature-controlled liquid channel 130.

On the temperature-controlled liquid channel member 131, a case 150 and a lid 151 are stacked in this order.

As illustrated in FIG. 5, the case 150 includes ink supply ports 122 for supplying the ink to the common supply channel 110, a temperature-controlled liquid supply port 132 coupled to the temperature-controlled liquid supply port 132*a* of the temperature-controlled liquid channel 130, and a temperature-controlled liquid collection port 133 coupled to the temperature-controlled liquid collection port 133*a*.

Figure 6:
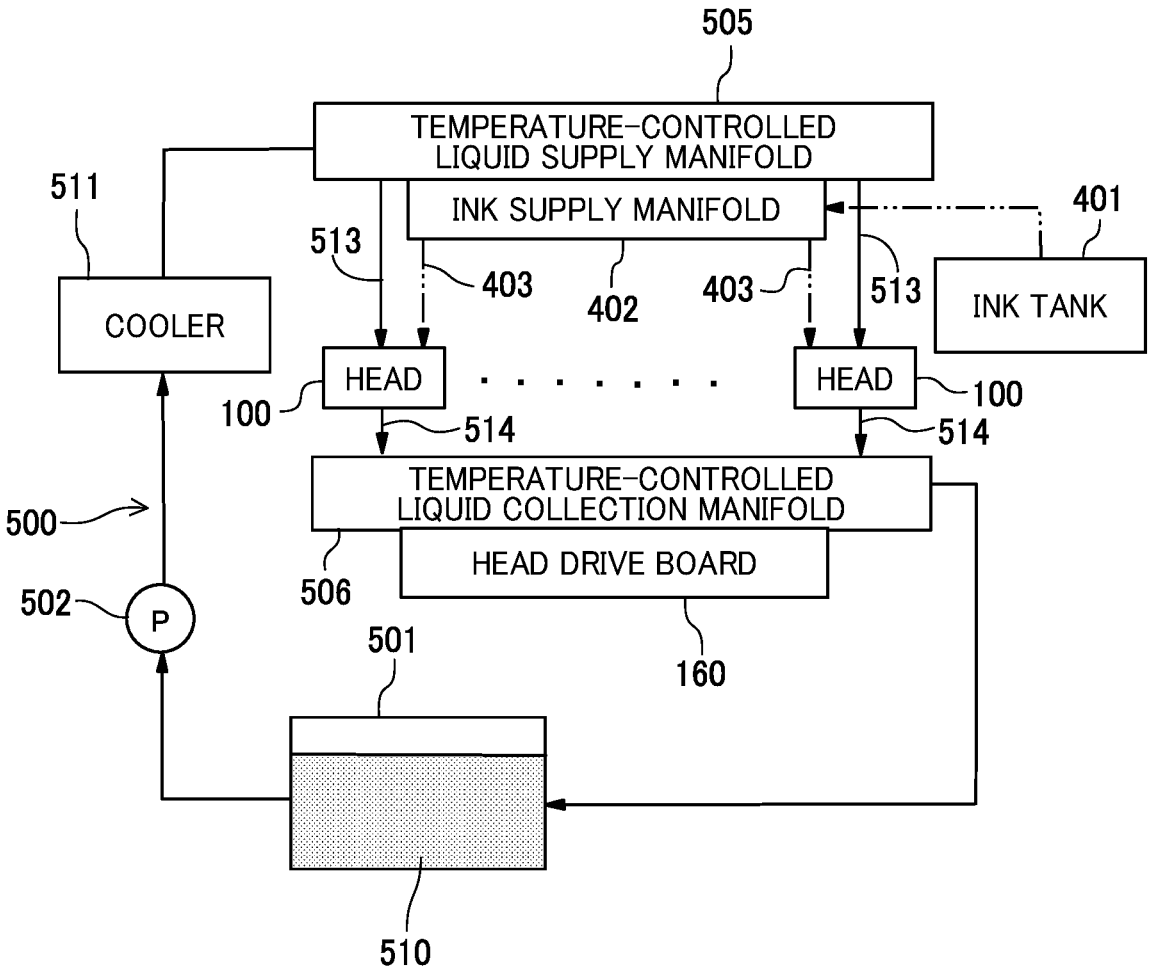
FIG. 6 is a block diagram illustrating a liquid (ink) supply system and a temperature-controlled liquid circulation system according to the first embodiment.
Figure 7:
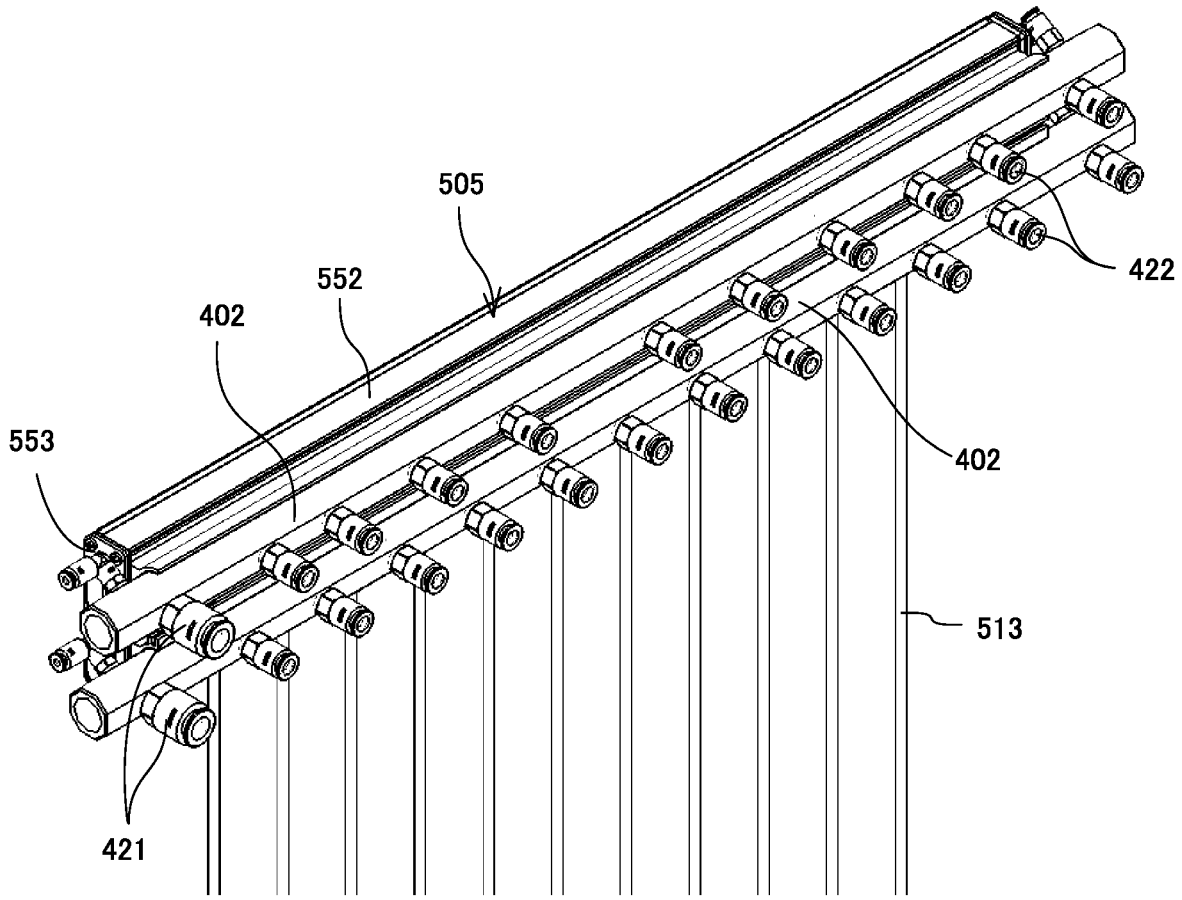
FIG. 7 is a perspective view illustrating an ink supply manifold and a temperature-controlled liquid supply manifold of FIG. 6, in an assembled state.
Figure 8:
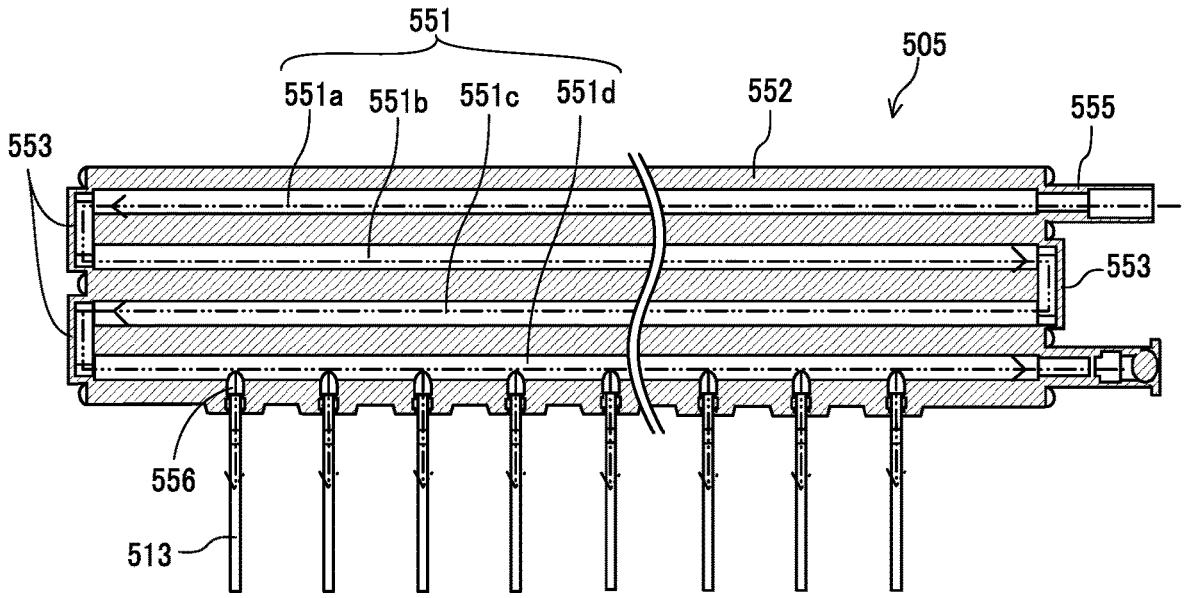
FIG. 8 is a cross-sectional view illustrating the temperature-controlled liquid supply manifold.

Next, a description is given below of a liquid (ink) supply system and a temperature-controlled liquid circulation system according to the first embodiment, with reference to FIGS. 6 to 8. FIG. 6 is a block diagram illustrating the liquid (ink) supply system and the temperature-controlled liquid circulation system. FIG. 7 is a perspective view illustrating an ink supply manifold and a temperature-controlled liquid supply manifold assembled together. FIG. 8 is a cross-sectional view illustrating the temperature-controlled liquid supply manifold.

The ink supply system includes an ink tank 401 (a liquid tank) that stores ink (liquid) to be supplied to the heads 100, and an ink supply manifold 402. The ink supply manifold 402 (a liquid supply manifold) distributes and supplies the ink (the liquid) supplied from the ink tank 401 to the plurality of heads 100. The ink supply manifold 402 and the heads 100 are coupled by an ink supply passage 403 such as a tube.

As illustrated in FIG. 7, the ink supply manifold 402 is a tubular member in which an ink channel 420 (see FIG. 13) is formed. The ink supply manifold 402 includes an inlet port 421 to which ink is supplied from the ink tank 401 and outlet ports 422 from which the ink is supplied to the heads 100, respectively.

The temperature-controlled liquid circulation system includes a temperature-controlled liquid tank 501 to store a temperature-controlled liquid 510, a liquid feed pump 502 to feed the temperature-controlled liquid 510, a cooler 511 to cool the temperature-controlled liquid 510, a temperature-controlled liquid supply manifold 505 to distribute and supply the temperature-controlled liquid 510 to the heads 100, and a temperature-controlled liquid collection manifold 506 to collect the temperature-controlled liquid 510 from the heads 100.

As illustrated in FIG. 8, the temperature-controlled liquid supply manifold 505 is a plate member in which a channel of the temperature-controlled liquid 510 is formed. The temperature-controlled liquid supply manifold 505 includes an inlet port 555 to which temperature-controlled liquid is supplied from the heat exchanger 503 and outlet ports 556 from which the temperature-controlled liquid is supplied to the heads 100, respectively.

The temperature-controlled liquid supply manifold 505 includes a manifold body 552 in which a plurality of liquid channels 551*a* to 551*d* extends along the longitudinal direction thereof. Further, folding-back caps 553 are attached to both ends of the manifold body 552.

The liquid channel 551*d* is provided with the outlet ports 556 to supply the temperature-controlled liquid 510 to the heads 100, respectively. The temperature-controlled liquid 510 is supplied from the outlet port 556 to the temperature-controlled liquid supply port 132 via a supply passage 513.

As illustrated in FIG. 7, the ink supply manifold 402 is fitted to the temperature-controlled liquid supply manifold 505, and thus the temperature-controlled liquid supply manifold 505 and the ink supply manifold 402 are thermally coupled.

The cooler 511 is, for example, a radiator.

The temperature-controlled liquid supply manifold 505 is coupled to the temperature-controlled liquid supply port 132 of each head 100 by the supply passage 513 such as a tube. The temperature-controlled liquid collection manifold 506 is coupled to the temperature-controlled liquid collection port 133 of each head 100 by a collection passage 514 such as a tube.

As the liquid feed pump 502 is driven, the temperature-controlled liquid 510 stored in the temperature-controlled liquid tank 501 circulates through the circulation passage 500 that passes through the liquid feed pump 502, the cooler 511, the temperature-controlled liquid supply manifold 505, each head 100, and the temperature-controlled liquid collection manifold 506. Then, the temperature-controlled liquid 510 returns to the temperature-controlled liquid tank 501.

On the head drive board 160, a drive waveform generation unit that generates a drive waveform to be applied to the piezoelectric actuators 111 (the pressure generators) of the plurality of heads 100 and a power amplification unit that amplifies the drive waveform are mounted. A heat generation portion of the head drive board 160 is thermally coupled to the temperature-controlled liquid collection manifold 506.

In the system configured as described above, the liquid feed pump 502 pumps up the temperature-controlled liquid 510 from the temperature-controlled liquid tank 501. Then, the temperature-controlled liquid 510 passes through the cooler 511 that cools the temperature-controlled liquid 510, and is distributed from the temperature-controlled liquid supply manifold 505 to the heads 100.

As the temperature-controlled liquid 510 passes through the temperature-controlled liquid channel 130 of each head 100, the temperature-controlled liquid 510 cools the frame 120 (a housing) of the head 100. After passing through the head 100, the temperature-controlled liquid 510 is collected in the temperature-controlled liquid collection manifold 506, cools the head drive board 160 (a drive circuit) to cool the power amplification unit and the like, and returns to the temperature-controlled liquid tank 501.

Meanwhile, the ink is supplied from the ink tank 401 to the ink supply manifold 402 and distributed to each head 100.

Since the temperature-controlled liquid supply manifold 505 and the ink supply manifold 402 are thermally coupled, the ink temperature in the ink supply manifold 402 is adjusted to the temperature of the temperature-controlled liquid 510 before the ink flows into each head 100. As a result, the temperature of the ink supplied from the ink supply manifold 402 is equalized. Accordingly, the temperature gradient among the heads 100 and that on the rows of the nozzles 104 are minimized (the temperature gradient in the nozzle row direction is minimized).

The circulation passage 500 of the temperature-controlled liquid 510 is thermally coupled to each of the frame 120 (the casing of the head 100) and the head drive board 160 on which the drive waveform generation unit and the power amplification unit that amplifies the drive waveform are mounted. The frame 120 and the head drive board 160 are heat generation portions.

In this case, the amount of the heat generated from the frame 120 is smaller than the amount of the heat generated from the head drive board 160. Therefore, the two heat generation portions, namely, the frame 120 and the head drive board 160, are thermally coupled to the circulation passage 500 in the order in which heat generation amount increases (in the ascending order of heat generation amount). That is, in the present embodiment, the frame 120 of the head 100 and the head drive board 160 are thermally coupled to the circulation passage 500 in this order in the direction of flow of the temperature-controlled liquid 510.

As a result, the order of cooling of the heat generation portions with the temperature-controlled liquid is in the ascending order of the amount of heat generation, and the cooling can be efficient.

In other words, in an arrangement in which a heat generation portion having a smaller heat generation amount is disposed downstream from a heat generation portion having a greater heat generation amount, the temperature-controlled liquid that has been cooled is heated by the heat generation portion having the greater heat generation amount, and the temperature of the temperature-controlled liquid rises. Then, the temperature-controlled liquid may be incapable of cooling even the heat generation portion having the smaller heat generation amount.

By contrast, as in the present embodiment, sequentially cooling the heat generation portions in the ascending order of heat generation amount can prevent a sharp temperature rise in the temperature-controlled liquid and reliably cool the heat generation portions.

Figure 9:
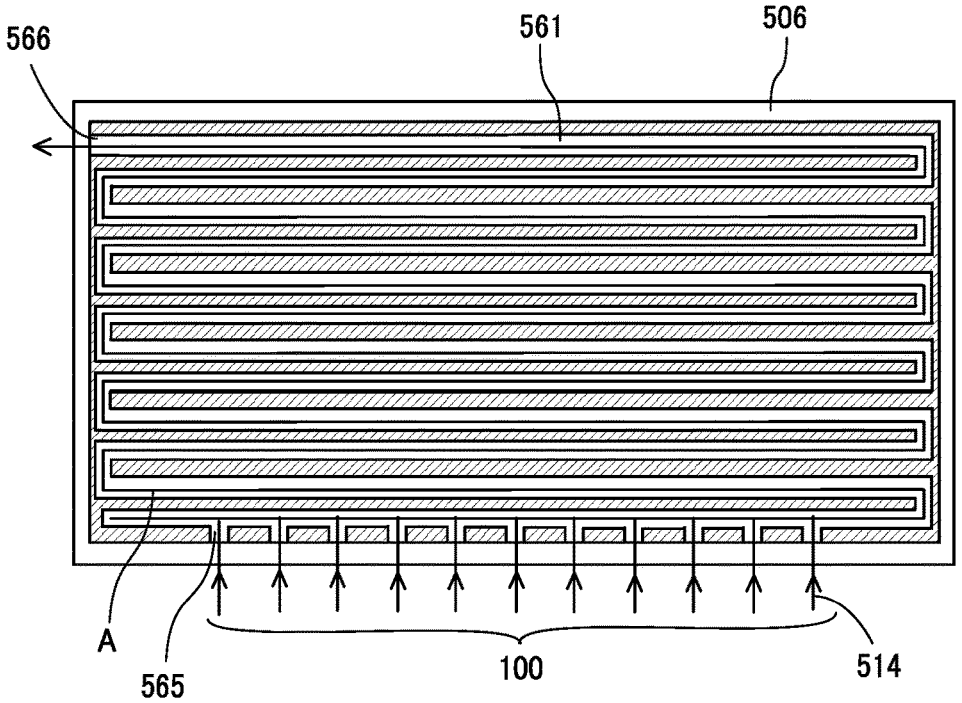
FIG. 9 is a front cross-sectional view illustrating a temperature-controlled liquid channel of the temperature-controlled liquid collection manifold.
Figure 10:
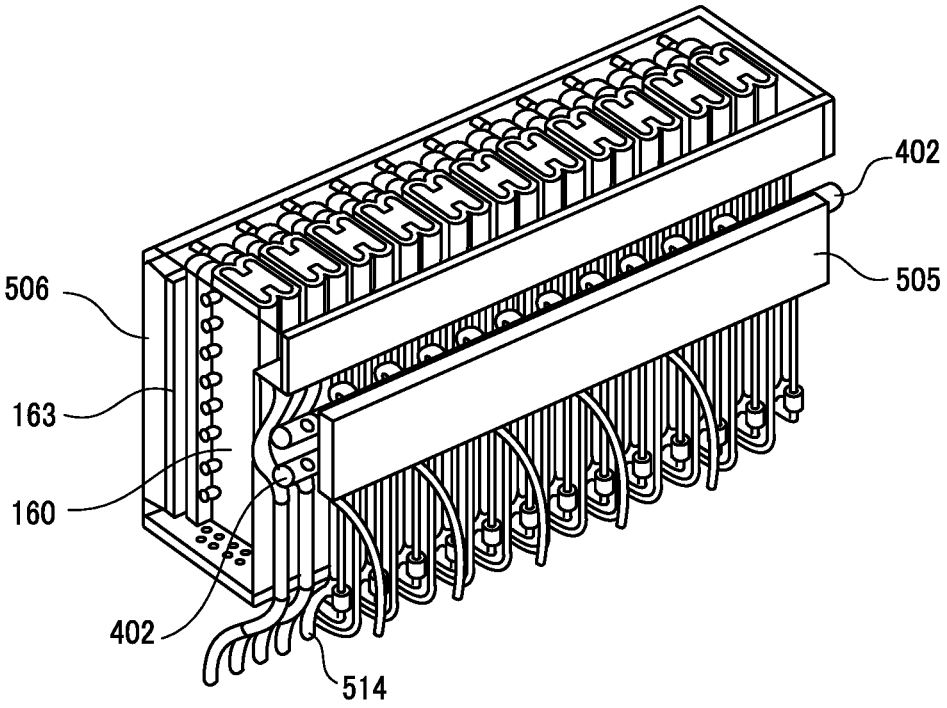
FIG. 10 is a perspective view illustrating a connection between the temperature-controlled liquid collection manifold and a head drive board according to the first embodiment.
Figure 11:
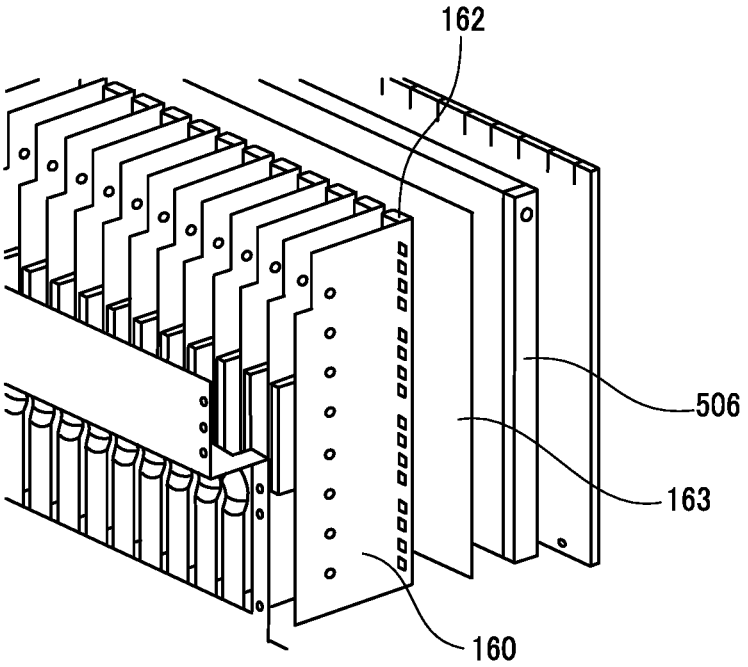
FIG. 11 is an exploded perspective view of the temperature-controlled liquid collection manifold and the head drive board illustrated in FIG. 10.
Figure 12:
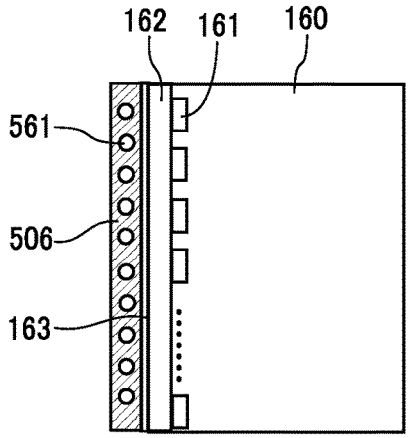
FIG. 12 is a side view illustrating the connection between the temperature-controlled liquid collection manifold and the head drive board illustrated in FIG. 10.

Next, a description is given of the temperature-controlled liquid collection manifold 506 and the thermal coupling of the temperature-controlled liquid collection manifold 506 with the head drive board 160, with reference to FIGS. 9 to 12. FIG. 9 is a front cross-sectional view illustrating in detail the temperature-controlled liquid channel of the temperature-controlled liquid collection manifold 506. FIG. 10 is a perspective view illustrating the connection between the temperature-controlled liquid collection manifold 506 and the head drive board 160. FIG. 11 is an exploded perspective view of the temperature-controlled liquid collection manifold 506 and the head drive board 160. FIG. 12 is a side view of the connection therebetween.

The temperature-controlled liquid collection manifold 506 has therein a liquid channel 561 through which the temperature-controlled liquid 510 supplied via the collection passage 514 from each head 100 flows. Arrow A indicates the direction of flow of the temperature-controlled liquid 510. The temperature-controlled liquid collection manifold 506 further includes inlet ports 565 coupled to the plurality of collection passages 514 and an outlet port 566 to discharge the temperature-controlled liquid 510 to the temperature-controlled liquid tank 501.

The liquid channel 561 is constructed of a plurality of channels extending along the longitudinal direction and includes turnups at both ends, so that the plurality of channels are connected.

On the head drive board 160, a power amplification unit 161 that amplifies a drive waveform is mounted, and a heatsink 162 is provided in contact with the power amplification unit 161. The power amplification unit 161 is constructed of, for example, a metal-oxide semiconductor field-effect transistor (MOSFET).

In this structure, the heatsink 162 of the head drive board 160 is secured to the temperature-controlled liquid collection manifold 506 via a heat conductive sheet 163, thereby thermally coupling the temperature-controlled liquid collection manifold 506 and the power amplification unit 161 of the head drive board 160.

Figure 13:
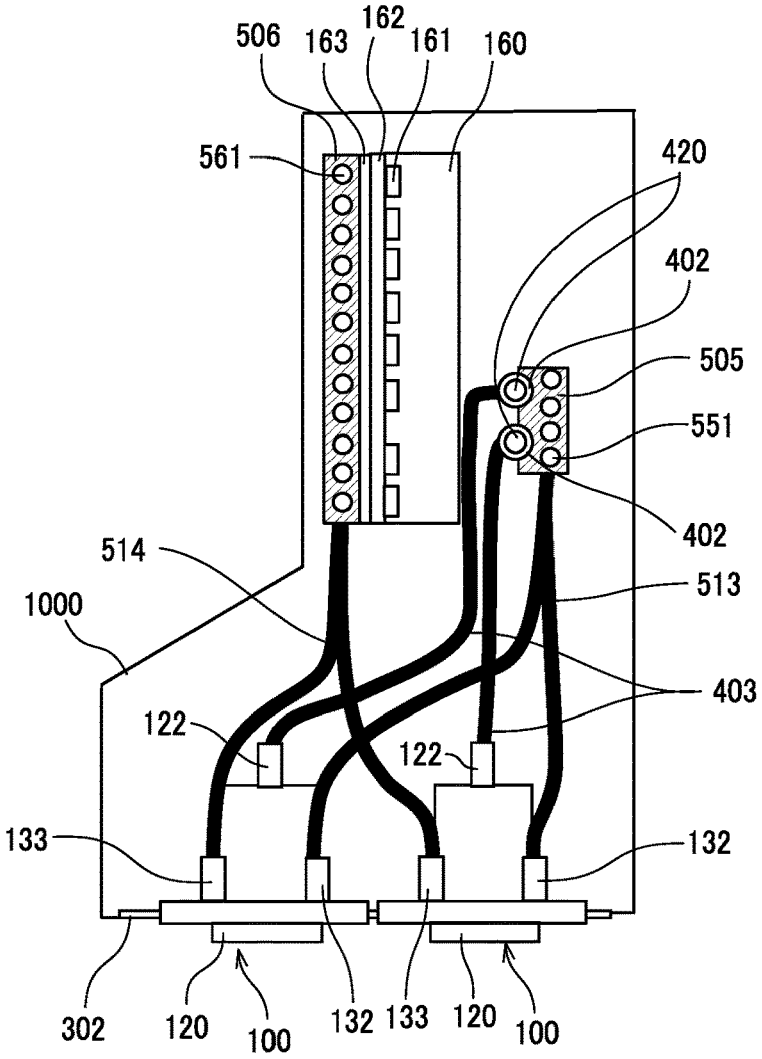
FIG. 13 is a view illustrating relative positions among the head, the temperature-controlled liquid supply manifold, and the temperature-controlled liquid collection manifold.

Next, a description is given of the positional relationship between the heads 100, the temperature-controlled liquid supply manifold 505, and the temperature-controlled liquid collection manifold 506, with reference to FIG. 13. FIG. 13 is a cross-sectional view illustrating the positional relationship thereof.

The temperature-controlled liquid collection manifold 506 and the temperature-controlled liquid supply manifold 505 are disposed above the heads 100. Therefore, in the present embodiment, the ink supply manifolds 402 that are thermally coupled to the temperature-controlled liquid supply manifold 505 are also above the heads 100.

The ink supply manifold 402 is coupled to the ink supply port 122 of the head 100 via the ink supply passage 403. Thus, the ink supply manifold 402 and the ink supply passage 403 construct a liquid supply passage through which the ink as liquid is supplied to the head 100. The temperature-controlled liquid supply manifold 505 is coupled to the temperature-controlled liquid supply port 132 of the head 100 via the supply passage 513. The temperature-controlled liquid collection manifold 506 is coupled to the temperature-controlled liquid collection port 133 of the head 100 via the collection passage 514.

The temperature-controlled liquid collection manifold 506 and the temperature-controlled liquid supply manifold 505 are disposed above the heads 100. With this arrangement, high image quality can be obtained without reducing the nozzle density (head arrangement density) of the heads 100. Further, the distance between the ink supply passage 403 and the supply passage 513 of the temperature-controlled liquid can be made short, and the temperature changes in each supply passage can be restricted.

Further, the frame 120 of the head 100, which is smaller in heat generation amount than the head drive board 160, is disposed lower than the head drive board 160, and the frame 120 of the head 100 and the head drive board 160 are thermally coupled to the circulation passage 500 in this order. Further, the head drive board 160 thermally coupled to the temperature-controlled liquid collection manifold 506 is disposed above the head 100. As a result, the order of cooling of the heat generation portions with the temperature-controlled liquid is in the ascending order of the amount of heat generation, and, additionally, the temperature rise of the head 100 can be inhibited.

The head unit 300, the temperature-controlled liquid collection manifold 506, and the temperature-controlled liquid supply manifold 505 are combined by a cover 1000. Thus, maintainability improves.

Figure 14:
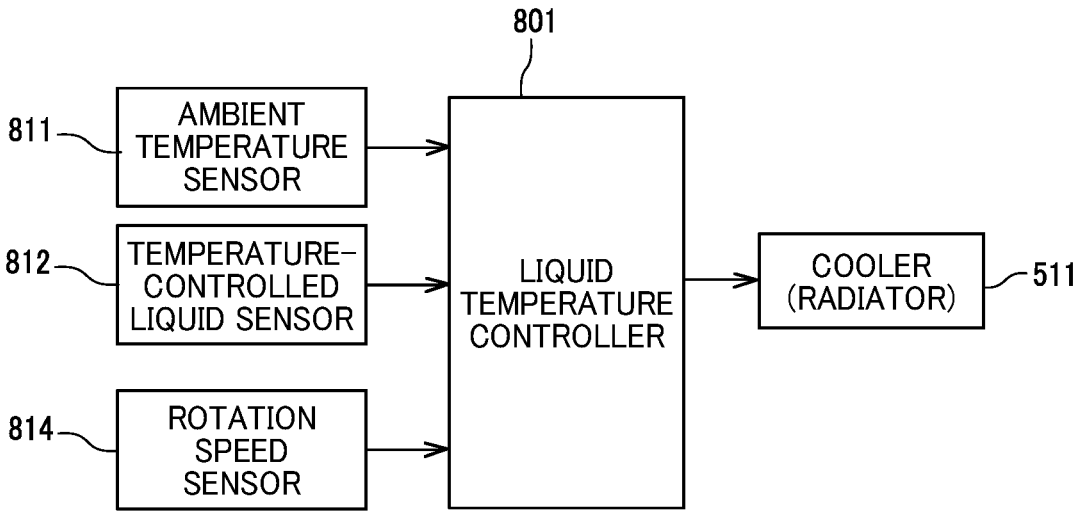
FIG. 14 is a block diagram illustrating a configuration of temperature control of the temperature-controlled liquid according to the first embodiment.

Next, a description is given of the temperature control of the temperature-controlled liquid, with reference to the block diagram in FIG. 14.

A temperature-controlled liquid temperature controller 801 receives detection results from an ambient temperature sensor 811 to detect an ambient temperature TH5, and a temperature-controlled liquid sensor 812 to detect a temperature TH1 of the temperature-controlled liquid 510 at the inlet of the cooler 511.

The temperature-controlled liquid temperature controller 801 further receives a detection result from a rotation speed sensor 814 that detects the rotation speed of a fan of the radiator serving as the cooler 511.

Then, the temperature-controlled liquid temperature controller 801 controls the fan of the cooler 511 based on such detection results input thereto.

Next, a brief description is given of, as an example, temperature control operation by the temperature-controlled liquid temperature controller 801 when the ambient temperature is lower than 25° C.

The temperature-controlled liquid 510 is controlled within a predetermined temperature range (e.g., 25° C. to 36.5° C.). When starting-up the apparatus in a low temperature environment, raising the ink temperature to a specified temperature is required. Therefore, a temperature raising drive waveform (a non-discharging waveform), from which a resonance point is excluded not to discharge ink, is applied to the piezoelectric actuator 111 of the head 100, and the temperature-controlled liquid 510 is heated by heat generated by the MOSFET of the head drive board 160 and heat generated by the piezoelectric actuator 111. Then, the temperature-controlled liquid 510 is circulated to heat the circulation passage 500, the interior of the head 100, and the ink supply passage upstream from the head 100.

Heating of the temperature-controlled liquid 510 is controlled as follows. In response to a detection that the temperature of the temperature-controlled liquid 510 associated with the ambient temperature is lower than a threshold temperature of 25° C., the temperature-controlled liquid temperature controller 801 turns off the cooler 511, detects the temperature TH1 of the temperature-controlled liquid 510 at the inlet of the cooler 511 of the circulation passage 500, and control the heat generation duty by the piezoelectric actuator 111, thereby heating the temperature-controlled liquid 510 to 25° C.

Further, in response to a detection that the temperature of the temperature-controlled liquid 510 is equal to or higher than the threshold temperature of 25° C., the temperature-controlled liquid temperature controller 801 stops the heat generation by the MOSFET of the head drive board 160 and the heating by the piezoelectric actuator 111, and shifts to a print standby state.

Further, when continuous printing is started and the temperature of the circulating temperature-controlled liquid 510 becomes equal to or higher than the threshold temperature of 25° C., the temperature-controlled liquid temperature controller 801 drives the cooler 511 to keep the temperature of the temperature-controlled liquid 510 within a range of the ambient temperature+3° C.

The cooling capacity of the cooler 511 is set to be capable of cooling the heat generation amount corresponding to the maximum ink amount of the head unit 300. Specifically, the cooling capacity is set in accordance with, as a breakdown, the amount of heat generated by the head drive board 160 including the power amplification unit 161 that amplifies the drive waveform applied to the piezoelectric actuator 111 of the head 100, the amount of heat generated by the piezoelectric actuator 111 in the head 100, and the amount of heat generated by the head driver IC that selects the piezoelectric element 112 to which the drive waveform of the piezoelectric actuator 111 in the head 100 is given.

Figure 15:
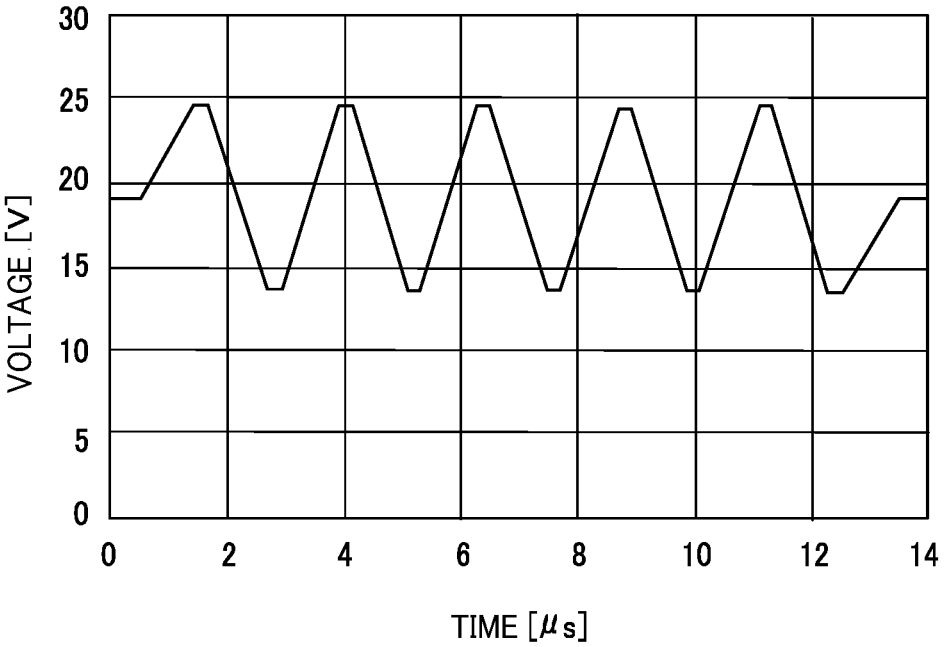
FIG. 15 is a graph illustrating an example of a drive waveform for raising the temperature of the temperature-controlled liquid.
Figures 16, 17:
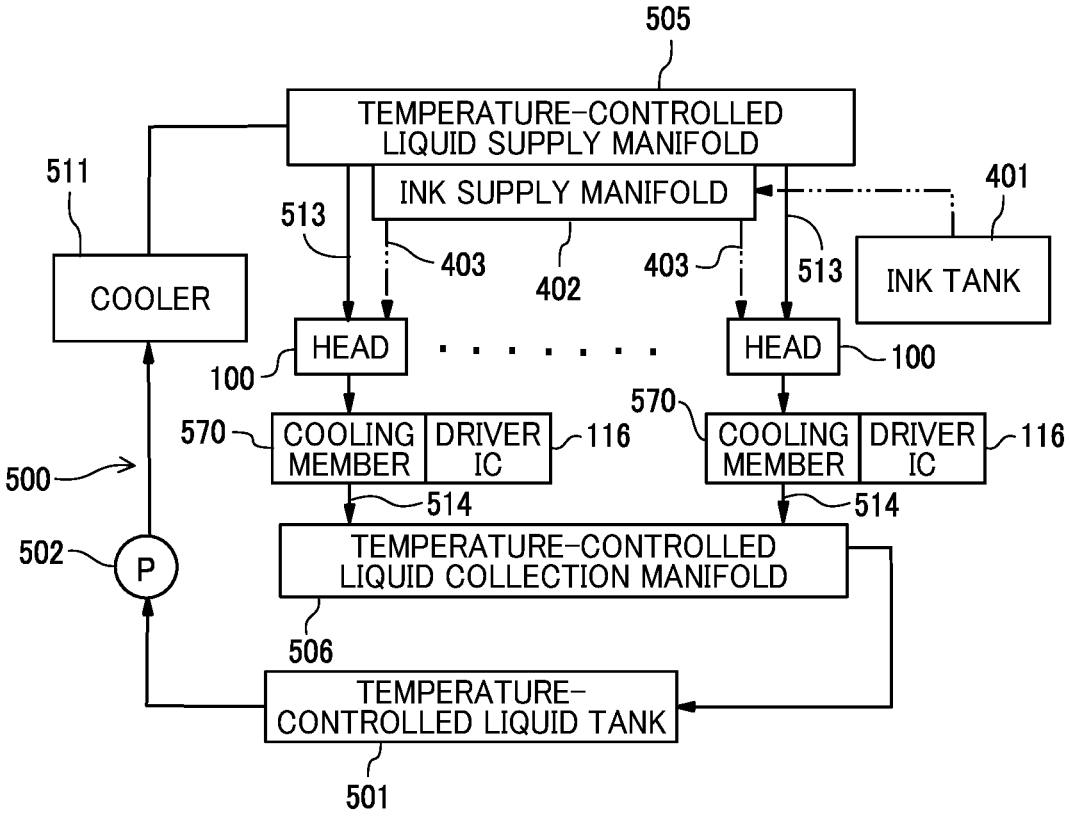
FIG. 16 is a table illustrating an example of the relationship between a duty (drive frequency) of the drive waveform for raising the temperature of the temperature-controlled liquid and the temperature of the temperature-controlled liquid.
FIG. 17 is a block diagram illustrating a liquid supply system and a temperature-controlled liquid circulation system according to a second embodiment of the present disclosure.

Next, operation control at startup in a low temperature environment is described with reference to FIGS. 15 and 16. FIG. 15 is a graph illustrating an example of the drive waveform for raising the temperature of the temperature-controlled liquid. Referring to FIG. 16, which is a table illustrating an example of the relations between a drive waveform duty (drive frequency) for raising the temperature of the temperature-controlled liquid and the temperature TH1 of the temperature-controlled liquid, a description is given of the relations among the ambient temperature, the temperature TH1, and the drive waveform duty.

In the case of startup at a low temperature, the temperature of the head, the temperature of the ink, and the temperature of the temperature controlled liquid are the same as or similar to the ambient temperature (the low temperature). Therefore, the viscosity of the ink is significantly higher (thickened) than that at an ordinary temperature, and the target discharge properties are not obtained.

Therefore, when the apparatus is started up in a low temperature environment, a temperature raising drive waveform such as that illustrated in FIG. 15 is applied to the head drive board 160 and the piezoelectric element 112 of the head 100. From the temperature raising drive waveform, a resonance point is excluded.

Additionally, the temperature-controlled liquid temperature controller 801 drives the liquid feed pump 502 to circulation the temperature-controlled liquid, and raise the temperatures of the temperature-controlled liquid and the circulation passage 500 to around the ordinary ambient temperature by the temperature rise of the head 100 via the thermal coupling between the ink supply manifold 402 and the temperature-controlled liquid supply manifold 505.

At this time, the heat generation amount can be controlled by controlling the head drive board 160 and the drive frequency of the temperature raising drive waveform applied to the piezoelectric elements 112. For example, when the ambient temperature is 10° C., the head drive board 160 is heated with a heat generation amount of 8 KW (a frequency of 40 KHz), to sharply raise the temperature in the circulation passage 500. As the temperature in the circulation passage 500 reaches the target of ink temperature control, that is, the ordinary temperature, the drive frequency is reduced to reduce the heat generation amount in order to avoid an overshoot.

For example, as illustrated in FIG. 16, the temperature-controlled liquid temperature controller 801 changes the drive frequency (duty) of the temperature raising drive waveform applied to the head drive board 160 in accordance with the temperature TH1 of the temperature-controlled liquid flowing into the radiator serving as the cooler 511. As described above, the temperature TH1 is detected with the temperature-controlled liquid sensor 812 at the inlet of the cooler 511 to control the temperature of the cooler 511.

On one head drive board 160, eight drive wave generation circuits and eight drive waveform amplification units are mounted, and the maximum heat generation amount of the head drive board 160 is 290 W per sheet. Further, since 11 head drive boards 160 are mounted corresponding to 11 heads that form nozzle arrays for one color, the maximum calorific value of the four colors is 12 KW. Accordingly, the time of startup at a low temperature can be relatively short.

The resonance point of the pressure chamber 106 is excluded from the temperature-raising drive waveform illustrated in FIG. 15, and the waveform length thereof is set to 14 μm, so that the drive frequency is variable to control the heat generation amount. For example, since the period of a frequency of 60 KHz is 16.7 μs, applicable frequency is up to 60 KHz when a waveform is generated with 14 μs. In the table (FIG. 16) according to the present embodiment, the amount of heat generated upon application of a frequency of 40 KHz is set to 100% for controlling the heat generation amount.

Next, a second embodiment of the present disclosure is described with reference to FIG. 17. FIG. 17 is a block diagram illustrating a liquid (ink) supply system and a temperature-controlled liquid circulation system according to the second embodiment.

In the present embodiment, the circulation passage 500 includes a cooling member 570 that cools driver ICs 116 of the head 100. The driver IC 116 is mounted on the wiring member 115 of the head 100. The driver IC 116 includes a waveform generation unit of a nozzle drive element and a power amplification unit and drives a head actuator (e.g., the piezoelectric actuator 111).

The driver IC 116 according to the present embodiment is an integrated circuit in which the waveform generation unit, the power amplification unit, and the like mounted on the head drive board 160 according to the first embodiment are integrated at high density for each nozzle row. The driver IC 116 includes the waveform generation unit that generates the waveform applied to the piezoelectric actuators 111 (the pressure generators) of the head 100, and the power amplification unit that amplifies the waveform.

The temperature-controlled liquid is supplied from the temperature-controlled liquid supply manifold 505 to the frames 120 of the heads 100. The temperature-controlled liquid passing through the frame 120 is supplied to the cooling member 570 and then is collected in the temperature-controlled liquid collection manifold 506.

The circulation passage 500 includes two heat generation portions different in heat generation amount, namely, the frame 120, which is the casing of the head 100, and the driver IC 116. In the present embodiment, in the circulation passage 500, the heat generation portions are disposed downstream from the cooler 511 as a starting point in the direction of low of the temperature-controlled liquid and in the ascending order of the amount of heat generation, in this case, in the order of the frame 120 as the casing and the driver IC 116.

As a result, the heat generation portions are cooled with the temperature-controlled liquid in the ascending order of the amount of heat generation, and the cooling can be efficient.

Figure 18:
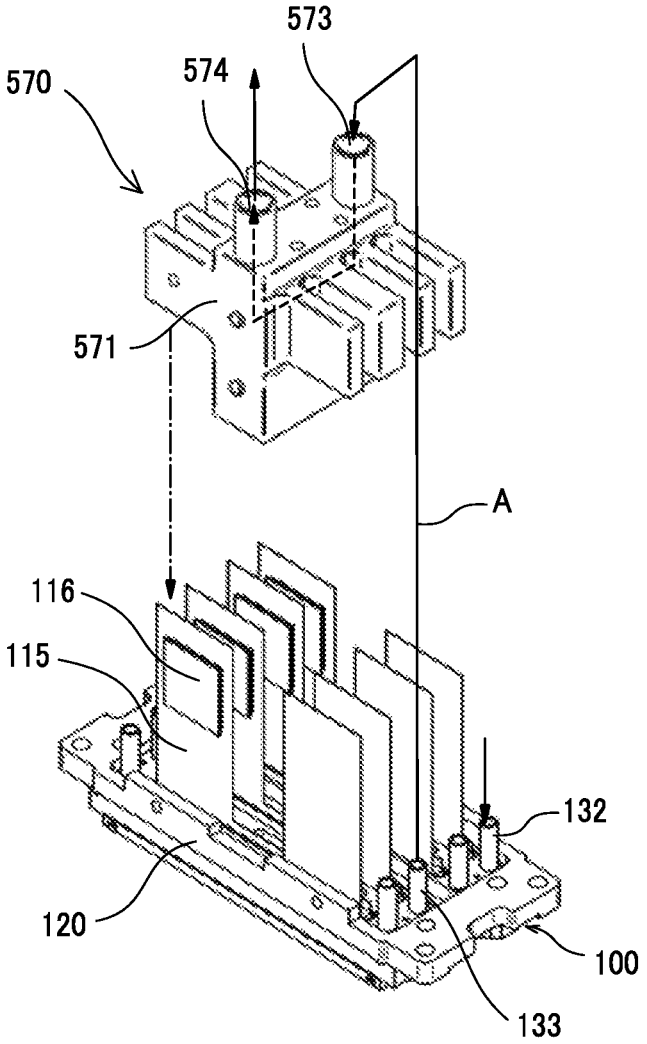
FIG. 18 is an exploded perspective view of a head and a cooling member of the head to cool a head driver integrated circuit (IC) provided with a waveform generation unit of a nozzle drive element and a power amplification unit.
Figure 19:
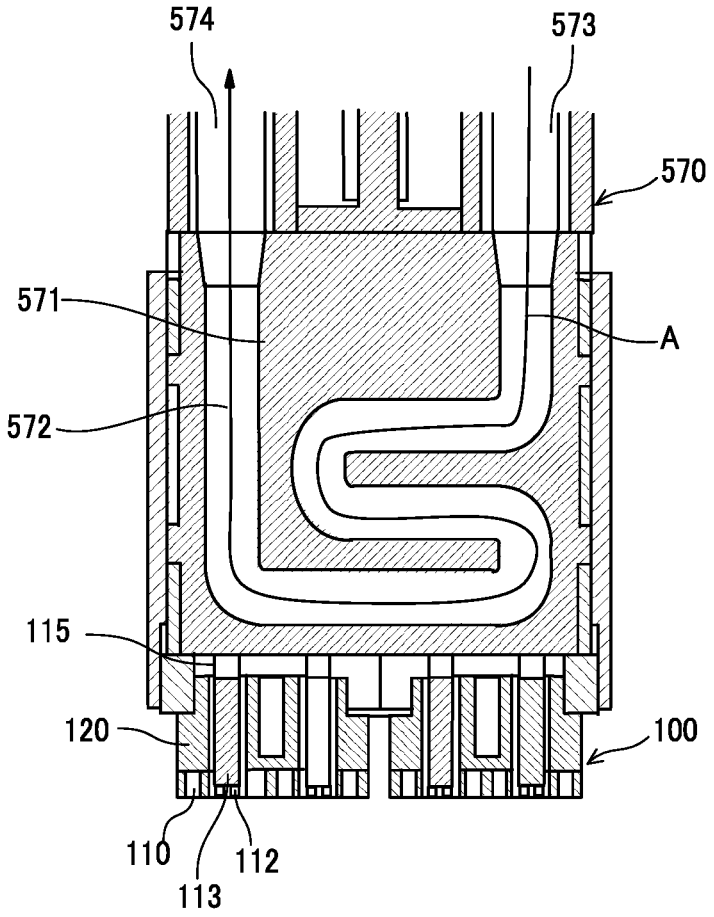
FIG. 19 is a partial cross-sectional view of the head illustrated in FIG. 18, in the direction perpendicular to the nozzle row direction, and illustrates a temperature-controlled liquid channel in the cooling member.
Figure 20:
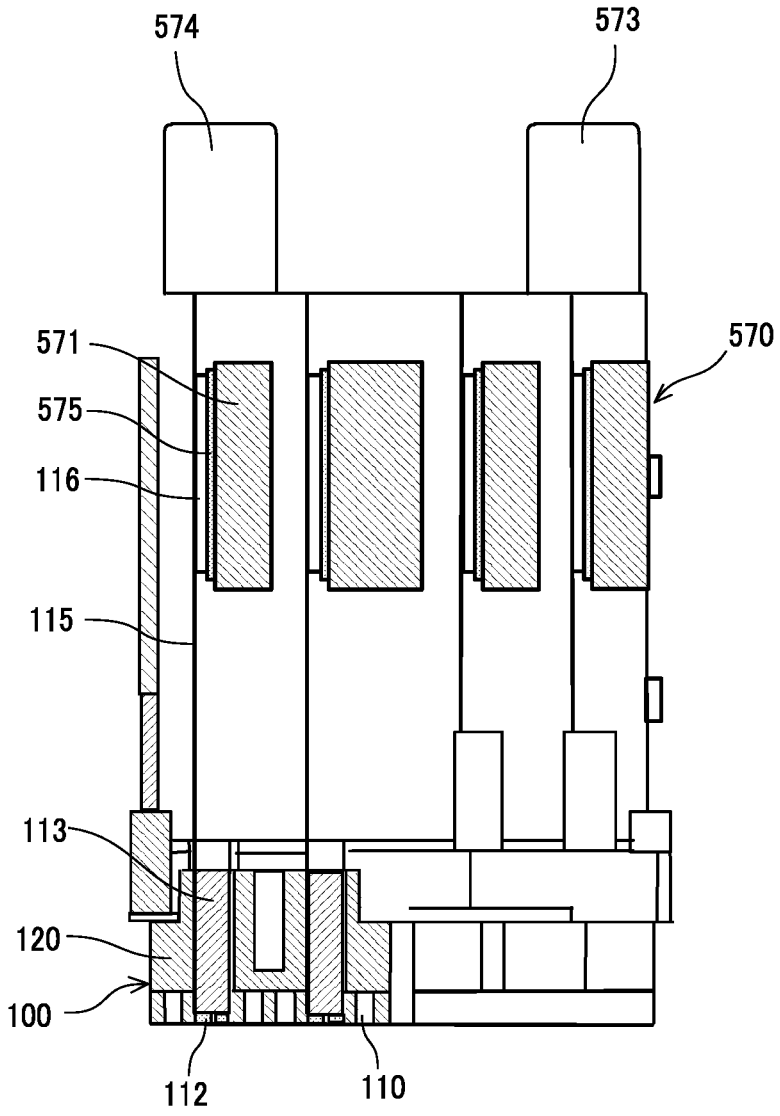
FIG. 20 is a partial cross-sectional view of the head illustrated in FIGS. 18 and 19 in the direction perpendicular to the nozzle row direction and illustrates the thermal coupling between the cooling member and the head driver IC.

Next, an example of the cooling member 570 is described with reference to FIGS. 18 to 20. FIG. 18 is an exploded perspective view illustrating the head 100 and the cooling member 570 separated from each other. FIG. 19 is a partial cross-sectional view of the head 100 and the cooling member 570 in the direction perpendicular to the nozzle row direction and illustrates a temperature-controlled liquid channel 572 in the cooling member 570. FIG. is a partial cross-sectional view thereof in the direction perpendicular to the nozzle row direction and illustrates the thermal coupling between the cooling member 570 and the driver IC 116.

The cooling member 570 includes a heat receiving portion 571. In the heat receiving portion 571, the temperature-controlled liquid channel 572 is formed so that the temperature-controlled liquid 510 flows therein. The temperature-controlled liquid channel 572 is provided with a supply port 573 and a collection port 574.

The heat receiving portion 571 of the cooling member 570 is thermally coupled, via a heat conduction sheet 575 (in FIG. 20), to the surface of the driver IC 116 mounted on the wiring member 115. The temperature-controlled liquid channel 572 through which the temperature-controlled liquid 510 flows is formed in the heat receiving portion 571 to be adjacent to the driver IC 116.

With this structure, as the temperature-controlled liquid 510 flows through the temperature-controlled liquid channel 572 of the cooling member 570 as indicated by arrow A in FIGS. 18 and 19, the driver IC 116 is cooled and heat generation is inhibited, thereby minimizing a temperature rise of the ink by the heat dissipation of the driver IC 116.

Figure 21:
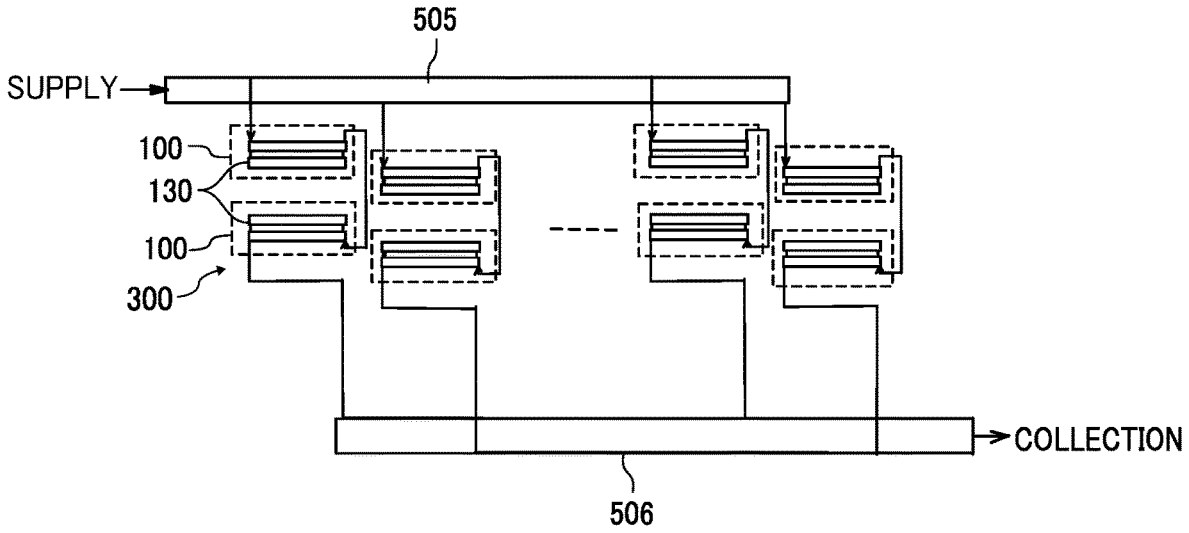
FIG. 21 is a diagram illustrating a configuration of a head unit and a temperature-controlled liquid circulation passage according to a third embodiment of the present disclosure.
Figure 22:
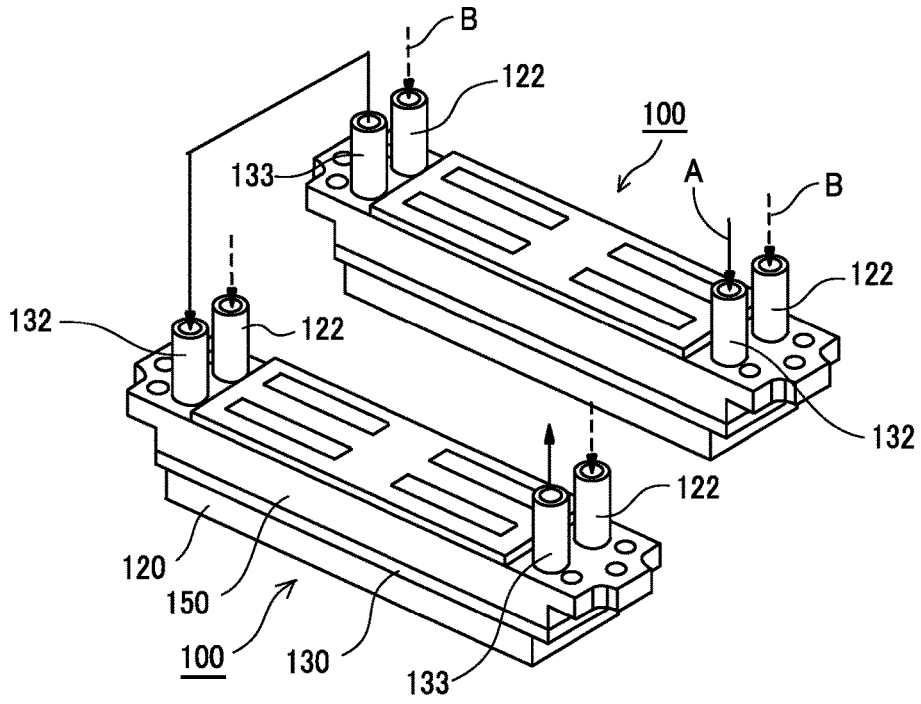
FIG. 22 is a perspective view illustrating a temperature-controlled liquid circulation passage of a dual head of the head unit illustrated in FIG. 21.

Next, a description is given of a third embodiment of the present disclosure, with reference to FIGS. 21 and 22. FIG. 21 is a view illustrating a configuration of the head unit and a circulation passage of the temperature-controlled liquid according to the third embodiment. FIG. 22 is a perspective view illustrating a temperature-controlled liquid circulation passage of a dual head.

The head unit 300 includes pairs of heads 100 (dual heads) to discharge liquid, arranged in a staggered arrangement.

As indicated by solid arrow A in FIG. 22, the temperature-controlled liquid 510 is supplied from the temperature-controlled liquid supply manifold 505 to the temperature-controlled liquid supply port 132 of the first one of the pair of heads 100. Then, the temperature-controlled liquid 510 passes through the frame 120 of the first head 100 and is collected from the temperature-controlled liquid collection port 133. The temperature-controlled liquid 510 collected from the first head 100 is supplied to the temperature-controlled liquid supply port 132 of the second head 100. Then, the temperature-controlled liquid 510 passes through the frame 120 of the second head 100 and is collected from the temperature-controlled liquid collection port 133.

The temperature-controlled liquid 510 collected from the temperature-controlled liquid collection port 133 of the second head 100 passes through the cooling member 570 and is collected in the temperature-controlled liquid collection manifold 506.

Note that ink is supplied to each head 100 through the ink supply port 122, as indicated by broken arrow B in FIG. 22.

Figure 23:
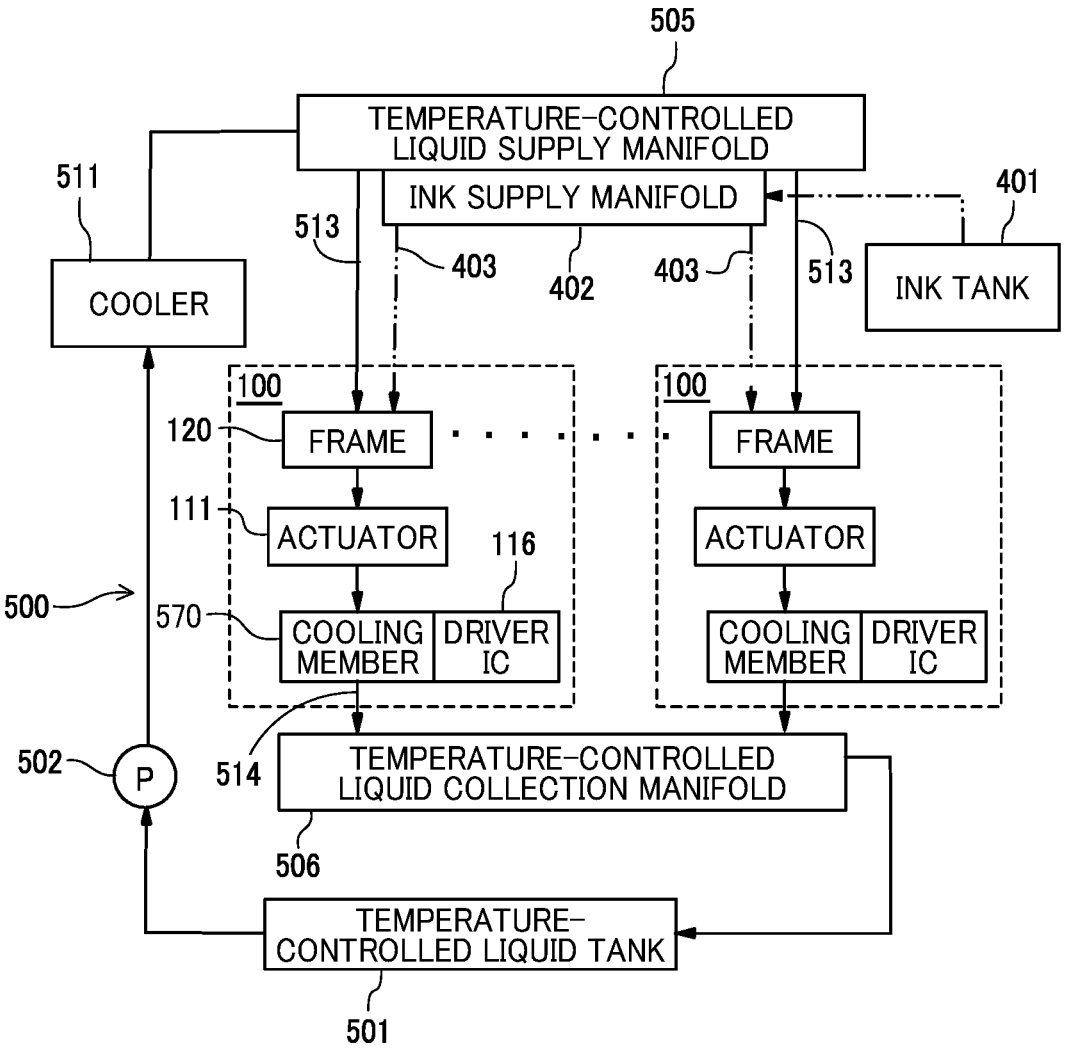
FIG. 23 is a block diagram illustrating a liquid (ink) supply system and a temperature-controlled liquid circulation system according to a fourth embodiment.

Next, a fourth embodiment of the present disclosure is described with reference to FIG. 23. FIG. 23 is a block diagram illustrating a liquid (ink) supply system and a temperature-controlled liquid circulation system according to the fourth embodiment.

The circulation passage 500 is thermally coupled to each of three heat generation portions different in heat generation amount, namely, the frame 120 (the housing) of the head 100, the base 113 of the piezoelectric actuator 111, and the driver IC 116.

The frame 120, the piezoelectric actuator 111, and the driver IC 116 different in heat generation amount are thermally coupled to the circulation passage 500 in the ascending order of heat generation amount, that is, in the order of the frame 120, the base 113, and the driver IC 116 from the cooler 511 as a starting point in the flow direction.

This enables efficient cooling.

Figure 24:
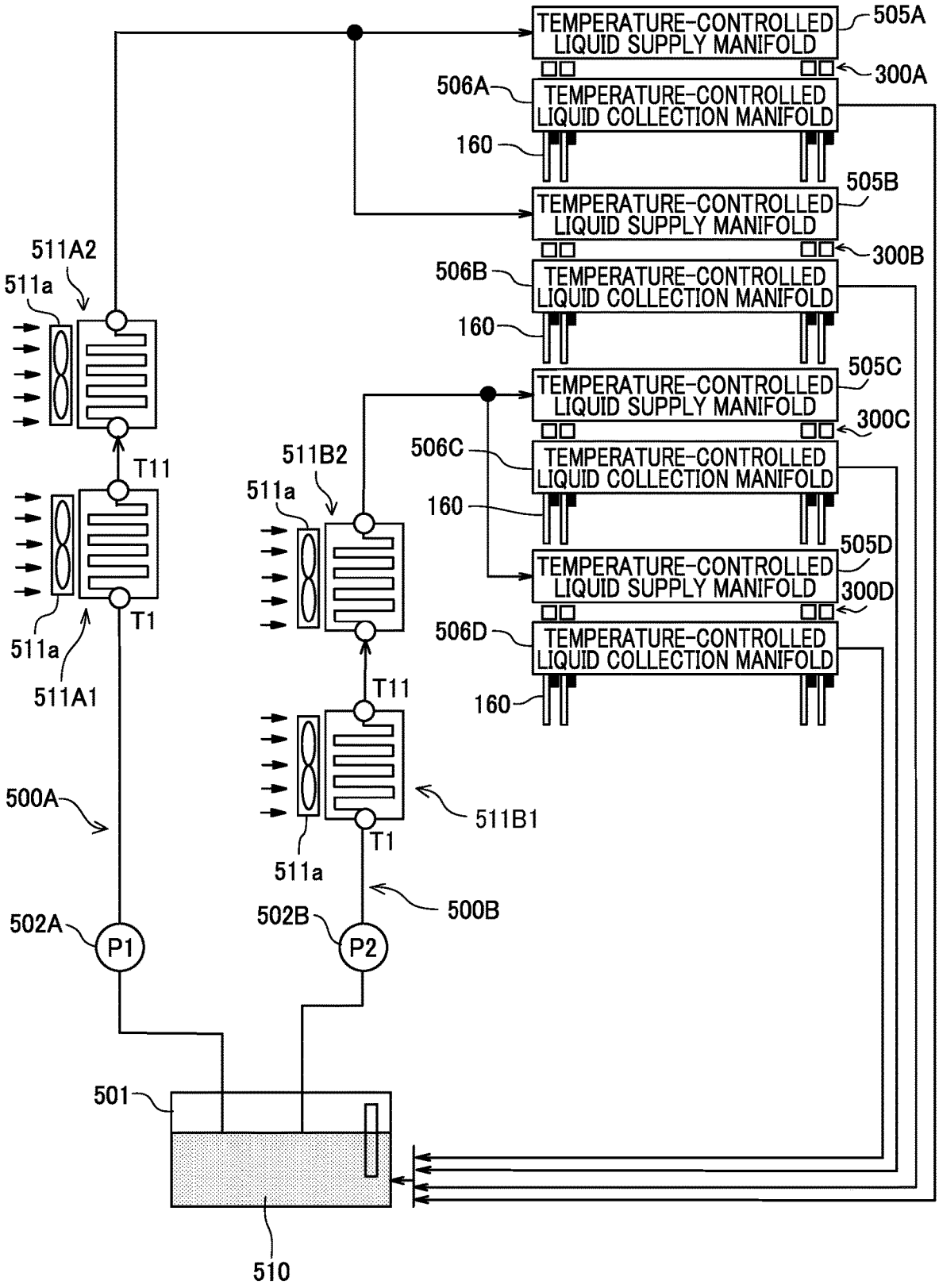
FIG. 24 is a schematic diagram of a temperature-controlled liquid circulation system according to a fifth embodiment of the present disclosure.

Next, a fifth embodiment of the present disclosure is described with reference to FIG. 24. FIG. 24 is a schematic diagram of a temperature-controlled liquid circulation system according to the fifth embodiment of the present disclosure.

The temperature-controlled liquid circulation system according to the present embodiment includes a plurality of temperature-controlled liquid supply manifolds 505 (505A to 505D) and a plurality of temperature-controlled liquid collection manifolds 506 (506A to 506D) corresponding to a plurality of head units 300 (300A to 300D). Each of the head unit 300 includes a plurality of heads 100 according to the first embodiment. That is, the printer 1 includes a plurality of head groups respectively for different color liquids.

The temperature-controlled liquid circulation system includes the temperature-controlled liquid tank 501 as a common tank and circulation passages 500A and 500B branched from the temperature-controlled liquid tank 501. From the common temperature-controlled liquid tank 501, the temperature-controlled liquid 510 is supplied to the temperature-controlled liquid supply manifolds 505A and 505B through the branched circulation passage 500A via a liquid feed pump 502A and radiators 511A (511A1 and 511A2) in direct connection).

Further, from the common temperature-controlled liquid tank 501, the temperature-controlled liquid 510 is supplied to the temperature-controlled liquid supply manifolds 505C and 505D through the branched circulation passage 500B via a liquid feed pump 502B and radiators 511B (511B1 and 511B2) in direct connection).

By contrast, the temperature-controlled liquid 510 that has passed through each of the head units 300A to 300D is collected by the corresponding one of the temperature-controlled liquid collection manifolds 506A to 506D, and then gathered and returned to the temperature-controlled liquid tank 501.

Thus, the circulation passage 500A starts from the temperature-controlled liquid tank 501, passes through the liquid feed pump 502A, the radiators 511A1 and 511A2, the temperature-controlled liquid supply manifolds 505A and 505B, the head units 300A and 300B, and the temperature-controlled liquid collection manifolds 506A and 506B, and then returns to the temperature-controlled liquid tank 501.

Similarly, the circulation passage 500B starts from the temperature-controlled liquid tank 501, passes through the liquid feed pump 502B, the radiators 511B1 and 511B2, the temperature-controlled liquid supply manifolds 505C and 505D, the head units 300C and 300D, and the temperature-controlled liquid collection manifolds 506C and 506D, and then returns to the temperature-controlled liquid tank 501.

Further, each temperature-controlled liquid collection manifold 506 is thermally coupled to the head drive board 160 to cool the power amplification unit, such as a MOSFET, which is mounted on the head drive board 160 and amplifies the drive waveform.

Also in this embodiment, similar to FIG. 13, the frame 120 of the head 100, having a smaller heat generation amount than the amount of heat generated by the head drive board 160, is disposed lower than the head drive board 160, and the frame 120 of the head 100 and the head drive board 160 are thermally coupled to the circulation passage 500 in this order. The head drive board 160 thermally coupled to the temperature-controlled liquid collection manifold 506 is disposed higher than the head 100. As a result, the heat generation portions are cooled with the temperature-controlled liquid in the ascending order of the amount of heat generation, and, the temperature rise of the head 100 can be inhibited.

In the present embodiment, the four radiators 511A1, 511A2, 511B1, and 511B construct the cooler, and the pair of serially connected radiators 511A1 and 511A2 and the pair of serially connected radiators 511B1 and 511B2 are connected in parallel into a mixed connection. However, alternatively, the four radiators 511A1, 511A2, 511B1, and 511B can be connected in parallel as in the second embodiment. The cooler can be constructed of a plurality of radiators connected in series, in parallel connection, or in a combination of series connection and parallel connection.

In the present embodiment, discharged liquid is not limited to a particular liquid as long as the liquid has a viscosity or surface tension to be discharged from a head (liquid discharge head). However, preferably, the viscosity of the liquid is not greater than 30 mPa·s under ordinary temperature and ordinary pressure or by heating or cooling. Examples of the liquid include a solution, a suspension, or an emulsion including, for example, a solvent, such as water or an organic solvent, a colorant, such as dye or pigment, a functional material, such as a polymerizable compound, a resin, a surfactant, a biocompatible material, such as deoxyribonucleic acid (DNA), amino acid, protein, or calcium, and an edible material, such as a natural colorant. Such a solution, a suspension, or an emulsion can be used for, e.g., inkjet ink, surface treatment liquid, a liquid for forming components of electronic element or light-emitting element or a resist pattern of electronic circuit, or a material solution for three-dimensional fabrication.

The term "head" signifies liquid discharge heads employing, as an energy source to generate energy to discharge liquid, a piezoelectric actuator (a laminated piezoelectric element or a thin-film piezoelectric element), a thermal actuator that employs an electrothermal transducer element, such as a heat element, or an electrostatic actuator including a diaphragm and opposed electrodes.

Examples of the liquid discharge apparatus include, not only apparatuses capable of discharging liquid to materials to which liquid can adhere, but also apparatuses to discharge a liquid toward gas or into a liquid.

The liquid discharge apparatus can include at least one of devices for feeding, conveying, and ejecting a material to which liquid can adhere. The liquid discharge apparatus can further include at least one of a pretreatment apparatus and a post-treatment apparatus.

The "liquid discharge apparatus" may be, for example, an image forming apparatus to form an image on a sheet by discharging ink, or a three-dimensional fabricating apparatus to discharge a fabrication liquid to a powder layer in which powder material is formed in layers to form a three-dimensional fabricated object.

The "liquid discharge apparatus" is not limited to an apparatus to discharge liquid to visualize meaningful images, such as letters or figures. For example, the liquid discharge apparatus can be an apparatus to form arbitrary images, such as arbitrary patterns, or fabricate three-dimensional images.

The above-mentioned term "material to which liquid can adhere" represents a material which liquid can, at least temporarily, adhere to and solidify thereon, or a material into which liquid permeates. Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell. The "material onto which liquid can adhere" includes any material on which liquid is adhered, unless particularly limited.

The above-mentioned "material to which liquid adheres" can be any material, such as paper, thread, fiber, cloth, leather, metal, plastic, glass, wood, ceramics, or the like, as long as liquid can temporarily adhere.

The liquid discharge apparatus may be an apparatus to relatively move a liquid discharge head and a material on which liquid can be adhered. However, the liquid discharge apparatus is not limited to such an apparatus. For example, the liquid discharge apparatus may be a serial head apparatus that moves the liquid discharge head or a line head apparatus that does not move the liquid discharge head.

Examples of the "liquid discharge apparatus" further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

The terms "image formation," "recording," "printing," "image printing," and "fabricating" used herein can be used synonymously with each other.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. A liquid discharge apparatus comprising:

a head configured to discharge a liquid;

a circulation passage through which a temperature-controlled liquid circulates, the circulation passage coupled to the head;

at least two heat generation portions different in heat generation amount from each other; and a cooler configured to cool the temperature-controlled liquid, the at least two heat generation portions thermally coupled with the circulation passage in an ascending order of heat generation amount and downstream from the cooler in a direction of flow in the circulation passage.

2. The liquid discharge apparatus according to claim 1, wherein the at least two heat generation portions include a housing of the head, a pressure generator, and a drive circuit in the ascending order of heat generation amount, the pressure generator disposed in the head and configured to discharge the liquid from the head, the drive circuit configured to drive the head.

3. The liquid discharge apparatus according to claim 1, further comprising a liquid supply passage through which the liquid is supplied to the head, the liquid supply passage thermally coupled with the circulation passage.

4. The liquid discharge apparatus according to claim 3, further comprising:

a plurality of heads including the head;

a liquid supply manifold configured to distribute the liquid to the plurality of heads; and a temperature-controlled liquid supply manifold configured to distribute the temperature-controlled liquid to the plurality of heads and thermally coupled with the liquid supply manifold.

5. The liquid discharge apparatus according to claim 3, further comprising:

a plurality of heads including the head, the plurality of heads grouped into a plurality of head groups different from each other in color of the liquid discharged;

a plurality of liquid supply manifolds each of which is configured to distribute the liquid to one of the plurality of head groups; and a plurality of temperature-controlled liquid supply manifolds each of which is configured to distribute the temperature-controlled liquid to one of the plurality of head groups, wherein each of the temperature-controlled liquid supply manifold is thermally coupled with corresponding one of the plurality of liquid supply manifolds, and wherein the circulation passage is configured to supply the temperature-controlled liquid from the cooler to the plurality of temperature-controlled liquid supply manifolds.

6. The liquid discharge apparatus according to claim 4, further comprising a temperature-controlled liquid collection manifold configured to collect the temperature-controlled liquid from the plurality of heads.

7. The liquid discharge apparatus according to claim 6, wherein the at least two heat generation portions include a drive circuit configured to drive the plurality of heads, and wherein the temperature-controlled liquid collection manifold is thermally coupled with the drive circuit.

8. The liquid discharge apparatus according to claim 7, wherein the drive circuit includes:

a power amplification unit configured to amplify a drive waveform applied to the plurality of heads; and a heatsink thermally coupled with the power amplification unit and the temperature-controlled liquid collection manifold.

9. The liquid discharge apparatus according to claim 1, wherein the head includes a pressure generator configured to generate pressure to discharge the liquid, wherein the at least two heat generation portions include a drive circuit configured to drive the head, wherein the liquid discharge apparatus further comprises:

a sensor configured to detect an ambient temperature; and control circuitry configured to:

turn off the cooler in response to a detection by the sensor that the ambient temperature is lower than a threshold temperature; and cause the drive circuit to apply a non-discharging waveform to the pressure generator to generate heat, to heat the temperature-controlled liquid to the threshold temperature, the non-discharging waveform with which the liquid is not discharged.

10. The liquid discharge apparatus according to claim 1, wherein the head includes:

a first liquid channel through which the liquid flows; and a second liquid channel through which the temperature-controlled liquid flows, the second liquid channel thermally coupled with the first liquid channel inside the head.

11. The liquid discharge apparatus according to claim 1, wherein one of the at least two heat generation portions having a smaller heat generation amount is disposed lower than other one of the at least two heat generation portions having a greater heat generation amount.

* * * * *